United States Patent [19]

Habu et al.

[11] 4,050,940

[45] Sept. 27, 1977

[54] PROCESS FOR THE PREPARATION OF A PHOTOGRAPHIC MATERIAL

[75] Inventors: Teiji Habu; Masao Ishihara; Eiichi Sakamoto; Hiroshi Yamada; Masaaki Kaneshige, all of Hino, Japan

[73] Assignee: Konishiroku Photo Industry Co., Ltd., Tokyo, Japan

[21] Appl. No.: 665,438

[22] Filed: Mar. 10, 1976

[30] Foreign Application Priority Data

Mar. 15, 1975 Japan ..... 50-31391

[51] Int. Cl.[2] ..... G03C 1/38; G03C 1/02; G03C 1/76; G03C 1/78

[52] U.S. Cl. ..... 96/114.5; 96/114.2; 96/87 A; 96/67

[58] Field of Search ..... 96/114.5, 114.2, 67, 96/87 A; 252/321, 358

[56] References Cited

U.S. PATENT DOCUMENTS

| | | | |
|---|---|---|---|
| 3,753,716 | 8/1973 | Ishihara et al. | 96/114.2 |
| 3,754,924 | 8/1973 | DeGeest et al. | 96/114.5 |
| 3,837,863 | 9/1974 | Sakazume et al. | 96/114.5 |
| 3,884,699 | 5/1975 | Cavallo et al. | 96/114.5 |

*Primary Examiner*—David Klein
*Assistant Examiner*—Louis Falasco

[57] ABSTRACT

A process for improving the coating of photographic materials by substantially removing coating irregularities and applying more uniform coatings is described.

4 Claims, No Drawings

PROCESS FOR THE PREPARATION OF A PHOTOGRAPHIC MATERIAL

The present invention relates to a process for the preparation of silver halide photographic materials, and specifically, a process of improving the coating property and thereby forming a uniform film in forming a structural layer of the photographic materials by coating with a variety of coating solutions for use in gelatin-silver halide photography.

As is well known, the photographic material comprises a support such as glass plate, baryta paper, polyethylene-laminated paper, nitrocellulose, cellulose acetate, polyester or polycarbonate, which support is coated with various photographic layers such as a subbing layer, a photosensitive emulsion layer, a protective layer, a filter layer, and an anti-halation layer. Usually, these layers are coated on the support by way of a dipping method, a double roll method and a slide hopper method, followed by drying, using coating devices,. At this coating, it is important to coat with these various coating solutions for photography throughout the surface of the support to a uniform thickness.

Coating defects observed when various photographic coating solutions are directly applied on the support tend to be different from coating defects observed when another coating solution is applied on an already-coated layer, depending on whether the coated layer is dry or in a cold-set state, or those observed when more than two coating solutions are double coated at the same time. This is because the surface mode or condition differs greatly and the above-mentioned defects are different according to the different mode or conditions. That is to say, it is quite important for the formation of a uniform coating to place the coating solution in a uniform wet state or expansion, regardless of the surface conditions.

In conventional coating processes, however, coating irregularities are often found and called as "lateral irregularities" or "longitudinal irregularities", which are respectively formed perpendicular to or in parallel with the coating direction. In addition, a partly incomplete coated state so-called "comets" is sometimes found resulting from foreign materials such as small amounts of dirt and dust, insoluble materials, coagulated materials and oleophilic materials which are present on the surface to be coated or present in a coating solution. Non-uniform coating called as "slippage" or "cutout" is also observed sometimes that accumulates themselves thick or, conversely, thin as the coating solution gathers together near the periphery of the coated surface or disperses away from the periphery of the coated surface.

Therefore, to prevent such non-uniformity in the coating layer, processes of prior art usually employ a coating aid such as saponin and lower down the surface tension of the coating solution. However, the saponin of a natural origin exhibits unstable quality depending upon the batches. Moreover, even if the saponin of the same quality is used, great variation is inevitable in regard to photographic properties as well as coating properties.

Therefore, various synthetic surfactants have now been used as coating aids to replace the saponin which has the above drawbacks. In practice, however, the conventional synthetic surfactants tend to deteriorate photographic properties particularly including storageability under the conditions of high temperature and high humidities, or they are lacking of high speed coating performance. Thus, the surfactants are effective only for specific photographic coating solutions or only under limited coating conditions and are not applicable for general purposes.

SUMMARY OF THE INVENTION

The object of the present invention is to provide a process for the preparation of light-sensitive photographic materials, the materials having uniform coatings free from deficiencies such as irregularities, comets, cissing, even when a variety of photographic coating solutions with or without various photographic binders such as gelatin are coated by high speed coating.

Another object of the present invention is to provide a coating which is capable of giving good wet state or expansion to the coating solution when a variety of photographic coating solutions are being coated by way of a simultaneous multi-layer coating system.

A further object of the present invention is to provide a process for the preparation of light-sensitive photographic materials which can provide stable, well-reproducible photographic properties, while having good wettability to a processing solution and showing no foamability in high speed automatic processing for development.

We have found that the aforementioned objects are attained when a compound represented by the following general formula is added as a coating aid to a variety of photographic coating solutions, in preparing the photographic materials for use in photography:

$$H(CF_2CF_2)_lCH_2O(CH_2\underset{\underset{R}{|}}{C}HO)_m(CH_2\underset{\underset{OH}{|}}{C}HCH_2O)_nH$$

wherein R is hydrogen or methyl, $l$ is an integer of 2 to 10 inclusive, $m$ is an integer of 0 to 50 inclusive, and $n$ is an integer of 0 to 50 inclusive, provided that when $n$ is 1, R is methyl, and further provided that both $m$ and $n$ are not 0 simultaneously.

The compound of the above general formula (hereinafter called the compound of the formula) exhibits excellent surfactant effects and gives no adverse effects on the photosensitive emulsion. Among the compounds of the formula, are especially preferred compounds expressed when $n$ is 0, R is hydrogen, $l$ is 2 or 3 and $m$ is an integer of 5 to 20 inclusive in the formula or when $m$ is 0, $n$ is an integer of 5 to 20 inclusive and $l$ is 2 or 3. On the other hand, when $l$ is less than 2 in the formula, excellent surfactant effects are not obtained.

Besides, the compound of the formula does not at all exhibit unstable quality that is inherent in the saponin, but reduces the surface tension even in a small amount of use without the increase of the viscosity of the coating solutions. Therefore, by the use of the compound of the formula, no irregularities or comets are developed when coated at ordinary speed or even when coated at speeds as high as 40 meters per minute or when a coating solution containing small content of binders such as gelatine is employed, or even when multi-layer coated; it is possible to form a very uniform coating and to provide always stable coating properties.

In addition to improving the coating property, the compound of the formula gives advantages such as imparting antistatic properties to the photographic materials as well as preventing static marks, when the compound is contained in a protective layer, a backing layer, an overcoat layer, etc.

The compound of the formula is a surfactant containing fluorine atoms and exhibits superior surfactant effect to the conventional compounds having similar structures, owing to the introduction of fluorine atoms therein. Therefore, it is possible to use the compound of the formula to all or some of multi-layered coatings coated with one above another on the same support which coatings are prepared by a wet-on-wet method or a wet-on-dry method.

Moreover, the compound of the formula is excellent in regard to wetting properties due to which foaming in the coating solution are prevented; therefore, the compound does not cause bubbles when contacted to a processing solution during the treatment of the photographic material.

Some of the typical examples of the compounds of the formula and the synthesis examples thereof are illustrated below. These examples are not intended to restrict the compounds of the formula.

| Exemplified compound | $n_D^{30}$ |
|---|---|
| (1) $H(CF_2CF_2)_2CH_2O(CH_2CH_2O)_5H$ | 1.3852 |
| (2) $H(CF_2CF_2)_2CH_2O(CH_2CH_2O)_{10}H$ | 1.4056 |
| (3) $H(CF_2CF_2)_2CH_2O(CH_2CH_2O)_{20}H$ | 1.4431 |
| (4) $H(CF_2CF_2)_3CH_2O(CH_2CH_2O)_{10}H$ | 1.3774 |
| (5) $H(CF_2CF_2)_4CH_2OCH_2CH_2OH$ | 1.3350 |
| (6) $H(CF_2CF_2)_4CH_2O(CH_2CH_2O)_{10}H$ | 1.3387 |
| (7) $H(CF_2CF_2)_3CH_2O(CH_2CH_2O)_5H$ | 1.3774 |
| (8) $HCF_2CF_2CH_2O(CH_2CH_2O)_{10}H$ | 1.4308 |
| (9) $H(CF_2CF_2)_3CH_2OCH_2CH_2OH$ | 1.3376 |
| (10) $H(CF_2CF_2)_2CH_2OCH_2CH_2OH$ | 1.3412 |
| (11) $H(CF_2CF_2)_2CH_2O(CH_2\underset{\underset{OH}{\vert}}{C}HCH_2O)_5H$ | 1.4427 |
| (12) $H(CF_2CF_2)_3CH_2O(CH_2\underset{\underset{OH}{\vert}}{C}HCH_2O)_8H$ | 1.4462 |
| (13) $H(CF_2CF_2)_2CH_2O(CH_2\underset{\underset{OH}{\vert}}{C}HCH_2O)_7H$ | 1.4542 |
| (14) $H(CF_2CF_2)_3CH_2O(CH_2\underset{\underset{OH}{\vert}}{C}HCH_2O)_3H$ | 1.3975 |
| (15) $H(CF_2CF_2)_2CH_2O(CH_2\underset{\underset{OH}{\vert}}{C}HCH_2O)_3H$ | 1.4193 |
| (16) $H(CF_2CF_2)_2CH_2OCH_2\underset{\underset{OH}{\vert}}{C}HCH_2OH$ | 1.3703 |
| (17) $H(CF_2CF_2)_3CH_2OCH_2\underset{\underset{OH}{\vert}}{C}HCH_2OH$ | 1.3632 |
| (18) $H(CF_2CF_2)_4CH_2O(CH_2\underset{\underset{OH}{\vert}}{C}HCH_2O)_{10}H$ | 1.3329 (1% aq.) |
| (19) $H(CF_2CF_2)_8CH_2O(CH_2CH_2O)_{40}H$ | 1.4126 (1% aq.) |
| (20) $H(CF_2CF_2)_{10}CH_2O(CH_2CH_2O)_{50}H$ | 1.4562 (1% aq.) |
| (21) $H(CF_2CF_2)_6CH_2O(CH_2\underset{\underset{OH}{\vert}}{C}HCH_2O)_{30}H$ | 1.4462 (1% aq.) |
| (22) $H(CF_2CF_2)_8CH_2O(CH_2\underset{\underset{OH}{\vert}}{C}HCH_2O)_{40}H$ | 1.4366 (1% aq.) |
| (23) $H(CF_2CF_2)_3CH_2O(CH_2\underset{\underset{CH_3}{\vert}}{C}HO)_{10}H$ | 1.4458 |
| (24) $H(CF_2CF_2)_6CH_2O(CH_2\underset{\underset{CH_3}{\vert}}{C}HO)_{10}(CH_2\underset{\underset{OH}{\vert}}{C}HCH_2O)_{50}H$ | 1.4631 (1% aq.) |
| (25) $H(CF_2CF_2)_8CH_2O(CH_2CH_2O)_5(CH_2\underset{\underset{OH}{\vert}}{C}HCH_2O)_{20}H$ | 1.4275 (1% aq.) |
| (26) $H(CF_2CF_2)_4CH_2O(CH_2\underset{\underset{OH}{\vert}}{C}HCH_2O)_3(CH_2CH_2O)_{13}H$ | 1.4434 |
| (27) $H(CF_2CF_2)_2CH_2O(CH_2\underset{\underset{OH}{\vert}}{C}HCH_2O)_{20}(CH_2\underset{\underset{CH_3}{\vert}}{C}HO)_5H$ | 1.4362 (1% aq.) |

SYNTHESIS EXAMPLE 1

(Synthesis of Exemplified compound (1))

0.1 Mole of $H(CF_2CF_2)_2CH_2OH$, 1 ml of a 50% sodium hydroxide aqueous solution, and 0.5 mole of ethylene oxide are introduced into a pressure-resistant glass-made reaction tube or into a stainless steel autoclave, and heated for 3 hours at 90° C. The resulting is thereafter neutralized with glacial acetic acid, and then filtered. The excess of glacial acetic acid is removed under reduced pressure to obtain the compound. $n_D^{30}$ = 1.3852

SYNTHESIS EXAMPLE 2

(Synthesis of Exemplified Compound (2))

0.1 Mole of $H(CF_2CF_2)_2CH_2OH$, 1 ml of a 50% sodium hydroxide aqueous solution, and 1.0 mole of ethylene oxide are introduced into a pressure-resistant glass-made reaction tube or into a stainless steel autoclave, and heated for 3 hours at 90° C. The operation thereafter is the same as that of Synthesis Example 1. $n_D^{30}$ = 1.4056

SYNTHESIS EXAMPLE 3

(Synthesis of Exemplified compound (3))

0.05 Mole of $H(CF_2CF_2)_2CH_2OH$, 1 ml of a 50% sodium hydroxide aqueous solution, and 1.0 mole of ethylene oxide are introduced into a pressure-resistant glass-made reaction tube or into a stainless steel autoclave, and heated for 6 hours at 90° C. The operation thereafter is the same as that of Synthesis Example 1. $n_D^{30}$ = 1.4431

SYNTHESIS EXAMPLE 4

(Synthesis of Exemplified compound (4))

0.1 Mole of $H(CF_2CF_2)_3CH_2OH$, 1 ml of a 50% sodium hydroxide aqueous solution and 1.0 mole of ethylene oxide are introduced into a pressure-resistant glass-made reaction tube or into a stainless steel autoclave, and heated for 3 hours at 90° C. The operation thereafter is the same as that of Synthesis Example 1. $n_D^{30}$ = 1.3774

SYNTHESIS EXAMPLE 5

(Synthesis of Exemplified compound (5))

0.1 Mole of $H(CF_2CF_2)_4CH_2OH$, 30 ml of acetone, 1 ml of a 50% sodium hydroxide aqueous solution, and 0.1 mole of ethylene oxide are introduced into a pressure-resistant glass-made reaction tube or into a stainless steel autoclave, and heated for 3 hours at 90° C, thereafter neutralized with glacial acetic acid. The solvent is removed under reduced pressure. The rest is distilled under reduced pressure to obtain the compound. Boiling point, 92° - 105° C/3 mmHg, $n_D^{30}$ = 1.3350

SYNTHESIS EXAMPLE 6

(Synthesis of Exemplified compound (6))

0.1 Mole of $H(CF_2CF_2)_4CH_2OH$, 30 ml of acetone, 1 ml of a 50% sodium hydroxide aqueous solution and 1.0 mole of ethylene oxide are introduced into a pressure-resistant glass-made reaction tube or into a stainless steel autoclave, and heated for 3 hours at 90° C. The operation thereafter is the same as that of Synthesis Example 1. $n_D^{30}$ = 1.3387

SYNTHESIS EXAMPLE 7

(Synthesis of Exemplified compound (11))

In a flask equipped with a stirrer and a thermometer, 0.2 gram of potassium hydroxide is dissolved in 0.2 mole of $H(CF_2CF_2)_2CH_2OH$, and the resulting solution is dropwise added with 0.1 mole of glycidol, while maintaining the inner temperature at 130° C. After the dropwise addition has been completed, the mixture is heated for 4 hours and stirred. After cooling, the mixture is neutralized with glacial acetic acid, thereafter dissolved in a mixture solution of water and methanol (2:3), and extracted with a petroleum ether. The water-methanol layer is evaporated to dryness to obtain a faintly yellow viscous liquid. $n_D^{30} = 1.4427$

SYNTHESIS EXAMPLE 8

(Synthesis of Exemplified compound (12))

In a flask equipped with a stirrer and a thermometer, 0.2 g of potassium hydroxide is dissoled in 0.1 mole of $H(CF_2CF_2)_3CH_2OH$, and the resulting solution is slowly and dropwise added with 0.8 mole of glycidol, while maintaining the inner temperature at 130° C. After the dropwise addition has been completed, the mixture is heated for 4 hours and stirred. After cooling, the mixture is neutralized with glacial acetic acid, dissolved in a mixture liquid of water and methanol (2:3), and extracted with a petroleum ether. The water-methanol layer is evaporated to dryness to obtain a faintly yellow viscous liquid. $n_D^{30} = 1.4462$

SYNTHESIS EXAMPLE 9

(Synthesis of Exemplifid compound (13))

In a flask equipped with a stirrer and a thermometer, 0.2 g of a potassium hydroxide is dissolved in 0.1 mole of $H(CF_2CF_2)_2CH_2OH$, and the resulting solution is slowly added with 0.7 mole of glycidol, while maintaining the inner temperature at 130° C. After the dropwise addition has been completed, the mixture is heated for 4 hours and stirred. After cooling, the mixture is neutralized with glacial acetic acid, dissolved in a mixture solution of water and methanol (2:3), and extracted with a petroleum ether. The water-methanol layer is evaporated to dryness to obtain a faintly yellow viscous liquid. $n_D^{30} = 1.4542$

SYNTHESIS EXAMPLE 10

(Synthesis of Exemplified compound (23))

0.1 Mole of $H(CF_2CF_2)_3CH_2OH$, 2 ml of a 50% sodium hydroxide aqueous solution, and 1.0 mole of propylene oxide are introduced into a pressure-resistant glass-made reaction tube or into a stainless steel autoclave, and heated at 110° to 120° C for 6 hours. After cooling, the reaction mixture is neutralized with glacial acetic acid to obtain a colorless viscous liquid. $n_D^{30} = 1.4458$

SYNTHESIS EXAMPLE 11

(Synthesis of Exemplified compound (26))

In a flask equipped with a stirrer and a thermometer, one mole of $H(CF_2CF_2)_4CH_2OH$ and 0.2 g of potassium hydroxide are dissolved in 100 ml of xylene and stirred violently, and the resulting solution is slowly and dropwise added with 3 mole of glycidol with refluxing. After the dropwise addition has been completed, the mixture is stirred for 4 hours under refluxing. After cooling, the mixture is neutralized with glacial acetic acid, freed from xylene, and then dissolved in alcohol. The solution is filtered, and the filtrate is evaporated to dryness to obtain a white waxy product.

An 0.5 mole amount of the waxy product so obtained and 0.5 g of potassium hydroxide are dissolved in 300 ml of xylene, and stirred with refluxing. To the resulting solution is slowly blown 12.5 mole of ethylene oxide. After the completion of the reaction is confirmed by way of weight increase, the reaction product is neutralized with glacial acetic acid and freed from xylene. The product is dissolved in alcohol, filtered, and then evaporated to dryness to obtain a brown viscous liquid. $n_D^{30} = 1.4434$ In order to add the so obtained compound of the formula to the photographic coating solutions, the compound may be dissolved in an water-miscible organic solvent such as water or methanol, ethanol, or acetone. The amount of the compound added to the coating solution is 0.01 to 20 g per kilogram of the coating solution if the solution contains ordinary gelatine, and more preferably 0.05 to 10 g. Also, the timing of addition is usually just before the solution is coated. But in the case of a silver halide emulsion, the compound is added at any time during the aging step.

Layers in the light-sensitive photograhic material of the present invention include not only a light-sensitive silver halide emulsion layer but also an intermediate layer, a protective layer, a subbing layer, a filter layer, an anti-halation layer, and an overcoat layer, etc. And examples of silver halide emulsions to be used include a variety of photosensitive emulsions that are usually used for black-and-white emulsions, colored emulsions, X-ray emulsions, lith-type emulsions, diffusion-transfer emulsions, and substractive emulsions. The emulsions may contain a variety of silver halides such as silver chloride, silver bromochloride, silver iodobromochloride, silver bromide, silver iodobromide, etc.

In carrying out the present invention in effect, the most typical silver halide emulsion may be usually a gelatinous silver halide emulsion; other examples may be silver halide emulsions comprising acetylated gelatine, phthalated gelatine, or water-soluble cellulose derivatives, polyvinyl alcohol, or other hydrophilic synthetic or naturally-occuring high-molecular compounds as a binder.

These emulsions may contain chemical sensitizer nobel metal sensitizer such as gold compounds, palladium compounds, platinum compounds, rhodium compounds, iridium compounds, active or non-active selenium compounds, or sulfur sensitizer such as sodium thiosulfate, etc., or may further contain, as a development accelerator, such as thioether compounds, quaternary ammonium salts, or polyalkylene oxide compounds. And particularly preferred compounds are those disclosed in Japanese Patent Publication No. 13822/68, and Japanese Patent Publication No. 11116/72. The emulsions can be stabilized using azoles, azaindenes, and mercaptotetrazoles. The emulsions may further contain dihydroxyalkanes, cyclohexanedioles, acetylene alcohols, or wetting agents, plasticizers, or compounds for improving physical properties of coatings such as water-dispersible fine granular high molecular compounds obtained by emulsion polymerization. Furthermore, as a coating hardening agent, there may also be used, for example, aldehydes, ethylene imines, ketones, carboxylic acid derivatives, sulfonic esters, sulfonyl halides, vinyl sulfonates, active halogen compounds, epoxy compounds, isocyanates, and carbodiimides.

In the present invention, there may also be added any other conventional surfactants such as saponin, or, for example, surfactants of the sulfosuccinic acid type disclosed in British Patent No. 548532, surfactants of the type of alkylaryl polyethersulfonate disclosed in U.S. Pat. No. 3,026,202, or anionic or non-ionic surfactants of the type of alkylaryl polyether alcohol, or ampholytic surfactants containing ammonium- or phosphonium-type cations and carboxylate- or sulfonate-type anions, that are disclosed in Japanese Patent Application No. 73121/74, Japanese Patent Application No. 105379/74, and Japanese Early Publication No. 46733/74. Furthermore, the emulsions may further contain hydrophilic and oleophilic couplers, various dyes and dye carriers, or antistatic agents (for example, ethylene oxide addition polymer or glycidol addition polymer of the phenol aldehyde condensate, or aliphatic amines, amides, etc.) are disclosed in Japanese Early Publication No. 19213/73, and Japanese Patent Early Publication No. 74929/74), as well as various photographic additives such as optical brightners, UV-absorbers, anti-stain agents, matting agents, development inhibitors, and antioxidants. These additives may also be employed even when the compound of the formula is contained in the layers other than the emulsion layer. The emulsion may further be increased in spectral sensitivity by using, if necessary, cyanine dyes, merocyanine dyes, and styryl dyes.

The following is a Test Example to show that the compound of the formula is very effective to minimize the surface tension of a coating solution, in which the compound of the formula is added to a gelatine solution to measure the surface tension:

TEST EXAMPLE

To 5% gelatine solutions were added the Exemplified compounds (7) and (12) and saponine as a comparative compound in amounts of 0.6 g and 1.2 g per kilogram of gelatine solution. These solutions and the 5% gelatine solution to which was not added the compound were measured for their surface tension (37° C, dyne/cm). The results were as shown in Table 1 below.

Table 1

| Compound added | Amount added (in gram per kg of 5% gelatine solution) | Surface tension dyne/cm (37° C) |
|---|---|---|
| — | — | 49 |
| Exemplified compound (7) | 0.6 | 29 |
| | 1.2 | 27 |
| Exemplified compound (12) | 0.6 | 30 |
| | 1.2 | 29 |
| Saponin | 0.6 | 42 |
| | 1.2 | 39 |

As will be apparent from Table 1 above, the compound of the formula serves to markedly reduce the surface tension of the solution, which is far superior to the saponin employed by the conventional processes.

Therefore, the resulting coating is always uniform and does not adversely affect the photographic property. In this way, the compound of the formula exhibits excellent properties as a surfactant.

Next, the invention is illustrated below in detail with reference to the Examples, but these are not intended to limit the scope of the present invention thereto.

EXAMPLE 1

A silver bromochloride emulsion (containing 80 mole % of silver chloride) with 6% gelatine was separated into eight groups. To six groups among them were respectively added as aqueous solution the exemplified compounds (2), (4) and (14) in amounts of 2 g and 4 g per kilogram of the emulsion.

To one group among the two remaining groups was added saponin, as a comparative example, in an amount of 4 g per kilogram of the emulsion, and to the other remaining group was added no compound to use it as a blank sample. The so obtained eight emulsions were coated on a baryta paper at a speed of 40 meters per minute to prepare light-sensitive photographic positive materials.

After drying, each of these samples were measured for their coating and photographic properties. The results are as shown in Table 2. The sensitometry was performed after the exposure with a KS-IV-type sensitometer (manufactured by Konishiroku Photo Industry Co., Ltd.) through standard treatment using a developer D-72 (product from Eastman Kodak Co.). Relative speed of Table represents a relative value with the speed of the blank sample as 100 to which has been added no compound.

Table 2

| Compound added | Amount added (g/kg of emulsion) | Coating property: Number of repellencies (No./10m²) | Coating property: Number of comets (No./10m²) | Photographic property: Relative speed | Photographic property: Fog |
|---|---|---|---|---|---|
| — | — | 34 | 12 | 100 | 0.03 |
| Exemplified compound (2) | 2.0 | 0 | 0 | 100 | 0.03 |
| | 4.0 | 0 | 0 | 100 | 0.03 |
| Exemplified compound (4) | 2.0 | 0 | 1 | 100 | 0.03 |
| | 4.0 | 0 | 0 | 100 | 0.03 |
| Exemplified compound (14) | 2.0 | 1 | 0 | 100 | 0.04 |
| | 4.0 | 0 | 0 | 100 | 0.04 |
| Saponin | 4.0 | 3 | 1 | 100 | 0.04 |

As will be apparent from Table 2, the compounds of the formula exhibit excellent coating properties when coated at high speed with very little repellencies and comets, and give no adverse effects on the photographic properties.

EXAMPLE 2

A silver iodobromide emulsion containing 5% of gelatine (containing 2 mole % of silver iodide) was prepared for high speed X-ray photographic use. The emulsion was divided into fourteen groups, and to twelve groups among them were respectively added the exemplified compounds (1), (4), (7), (8), (12) and (17) in amount of 3 g and 5 g, per kilogram of emulsion. The resulting solutions were coated at a speed of 40 meters per minute on the polyester films which have been subbed. The films were set by cooling, and were then coated with 2.5% gelatin solutions each containing said exemplified compounds corresponding to the compounds used in the emulsions in an amount of 2 g per kilogram of the coating solution, as a protective layer and at the same coating speed. To the remaining two groups was similarly added a p-t-octyl-phenylpolyethylene glycol ether (comparative compound A), and the solutions were coated to form an emulsion layer and a protective layer thereby obtaing comparative samples.

The results of the coated samples are shown in Table 3 below. Relative speed in Table is a relative value with the speed of the sample having a coating in which was added 3 g of the comparative compound A per kilogram of the emulsion, as 100.

Table 3

| Compound added | Emulsion layer added (g/kg emulsion) | Protective layer added (g/kg.25% gelatine) | Coating property: Number of repellencies (No./10m²) | Coating property: Number of comets (No./10m²) | Photographic property: Relative speed | Photographic property: Fog |
|---|---|---|---|---|---|---|
| Exemplified | 3.0 | 2.0 | 0 | 1 | 100 | 0.07 |
| compound (1) | 5.0 | 2.0 | 0 | 0 | 100 | 0.07 |
| Exemplified | 3.0 | 2.0 | 0 | 0 | 100 | 0.08 |
| compound (4) | 5.0 | 2.0 | 0 | 0 | 97 | 0.07 |
| Exemplified | 3.0 | 2.0 | 0 | 0 | 100 | 0.08 |
| compound (7) | 5.0 | 2.0 | 0 | 0 | 100 | 0.07 |
| Exemplified | 3.0 | 2.0 | 1 | 0 | 100 | 0.07 |
| compound (8) | 5.0 | 2.0 | 0 | 0 | 98 | 0.07 |
| Exemplified | 3.0 | 2.0 | 0 | 0 | 100 | 0.07 |
| compound (12) | 5.0 | 2.0 | 0 | 0 | 100 | 0.07 |
| Exemplified | 3.0 | 2.0 | 1 | 0 | 100 | 0.08 |
| compound (17) | 5.0 | 2.0 | 0 | 0 | 100 | 0.07 |
| Comparative | 3.0 | 2.0 | 4 | 3 | 100 | 0.08 |
| compound A | 5.0 | 2.0 | 2 | 2 | 98 | 0.09 |

As will be clear from the results of Table 3 above, the coating containing the comparative compound presents defective coating properties, whereas the samples containing the compounds of the formula hardly develops defects such as repellencies and comes when coated over other coatings

EXAMPLE 3

A biaxially oriented polyethylene terephthalate film was subbed and then coated with the same high speed silver halide emulsion for X-ray photography as used in Example 2 and with a protective layer-forming solution (the two solutions containing saponin as a surfactant). The resulting film was divided into several pieces, and on which were overcoated the solutions of 0.5 g of the exemplified compounds (4), (7) and (13) and 100 ml of methanol or a pure methanol solution, and the samples were dried at 30° C for 3 minutes.

It was confirmed that the methanol solutions containing the compounds of the formula exhibits excellent properties as compared to a mere methanol solution without the compounds. Then the films overcoated with these solutions were closely superposed on a sensitizing screen for X-ray in a dark room, and then subjected to a determined amount of abrasion from the side of the brightening paper using a rubber roller under a relative humidity condition of 30%, and then subjected to the developing treatment to examine static marks. The film treated with the methanol solution not containing the compound of the formula caused static marks remarkably over the entire surface, whereas the films treated with the solutions containing the compounds of the formula did not at all show static marks.

The same test was effected to the samples of the aforementioned Examples 1 and 2. It was confirmed that the samples containing the compounds of the formula showed less static marks than the comparative samples.

What we claim is:

1. A process for the preparation of a gelatin-silver halide photographic layer thereon which comprises forming the layer by coating with a coating solution which contains a compound represented by the following formula:

$$H(CF_2CF_2)_1CH_2O(CH_2\underset{\underset{R}{|}}{C}HO)_m(CH_2\underset{\underset{OH}{|}}{C}HCH_2O)_nH$$

wherein R is hydrogen or methyl, *l* is an integer of 2 to 10 inclusive, *m* is an integer of 0 to 50 inclusive, and *n* is an integer of 0 to 50 inclusive, provided that when *n* is 1, R is methyl, and further provided that both *m* and *n* are not 0 simultaneously.

2. A process for the preparation of a gelatin-silver halide photographic material according to claim 1 wherein the layer is a photosensitive emulsion layer containing silver halide or a protective layer.

3. A process for the preparation of a gelatin-silver halide photographic material according to claim 1 wherein the compound is represented by the following formulas:

$$H(CF_2CF_2)_pCH_2O(CH_2CH_2O)_qH$$

or $$H(CF_2CF_2)_pCH_2O(CH_2-\underset{\underset{OH}{|}}{C}H-CH_2O)_qH$$

wherein p is 2 or 3 and q is an integer of 5 to 20 inclusive.

4. A process for the preparation of a gelatin-silver halide photographic material according to claim 3 wherein the compound is selected from the group consisting of:

$$H(CF_2CF_2)_3CH_2O(CH_2CH_2O)_5H$$

and $$H(CF_2CF_2)_3CH_2O(CH_2-\underset{\underset{OH}{|}}{C}H-CH_2O)_8H$$

* * * * *